United States Patent [19]

Lee

[11] Patent Number: 4,602,570

[45] Date of Patent: Jul. 29, 1986

[54] EXTENDABLE SHELF FOR A DISPLAY RACK

[75] Inventor: Vernon E. Lee, Bedford, Tex.

[73] Assignee: Frito-Lay, Inc., Dallas, Tex.

[21] Appl. No.: 501,086

[22] Filed: Jun. 6, 1983

Related U.S. Application Data

[63] Continuation-in-part of Ser. No. 383,614, Jun. 1, 1982.

[51] Int. Cl.[4] ..... A47B 11/00

[52] U.S. Cl. ..... 108/102; 108/137; 108/143; 211/150; 211/181

[58] Field of Search ..... 108/102, 143, 144, 137; 248/241, 243; 211/150, 151, 175, 181, 49 D, 59.1; 312/197

[56] References Cited

U.S. PATENT DOCUMENTS

| | | | |
|---|---|---|---|
| 827,050 | 7/1906 | Weston . | |
| 1,639,387 | 8/1927 | Seward | 211/49 D |
| 1,758,098 | 5/1930 | Williams | 211/59.2 |
| 1,940,877 | 12/1933 | Ochse | 211/185 |
| 2,103,885 | 12/1937 | Whalen | 211/143 |
| 2,199,981 | 5/1940 | Bell | 108/137 |
| 2,319,470 | 5/1943 | Nobles | 211/153 |
| 2,517,284 | 8/1950 | Calvert | 211/153 |
| 2,685,372 | 8/1954 | Palaith | 211/153 |
| 2,769,551 | 11/1956 | Just | 211/49 |
| 2,804,263 | 8/1957 | Fonde | 211/49 D |
| 2,932,408 | 4/1960 | Jacobson | 211/134 |
| 2,937,765 | 3/1960 | Shank | 211/143 |
| 3,027,016 | 3/1962 | Becht | 108/137 |
| 3,111,072 | 3/1977 | Pattison | 108/143 |
| 3,111,297 | 11/1963 | Conner | 248/210 |
| 3,221,677 | 12/1965 | Kerr | 108/102 |
| 3,242,885 | 3/1966 | Baker et al. | 108/137 |
| 3,388,808 | 6/1968 | Radek | 211/132 |
| 3,403,789 | 10/1968 | La Morte et al. | 211/150 |
| 3,765,344 | 10/1973 | Ferdinand | 108/108 |
| 3,780,873 | 12/1973 | Silva | 211/49 D |
| 3,794,183 | 2/1974 | Colbridge | 248/243 |
| 3,993,002 | 11/1976 | Stroh | 108/108 |
| 4,036,369 | 7/1977 | Eisenberg | 211/88 |
| 4,136,783 | 1/1979 | Karashima | 211/59.2 |

FOREIGN PATENT DOCUMENTS

| | | | |
|---|---|---|---|
| 592507 | 2/1960 | Canada | 248/243 |
| 51314 | 3/1922 | Sweden | 211/152 |
| 184098 | 6/1963 | Sweden | 211/59.3 |
| 225103 | 11/1924 | United Kingdom | 248/243 |

*Primary Examiner*—James T. McCall

*Attorney, Agent, or Firm*—Bernard, Rothwell & Brown

[57] ABSTRACT

An extendable shelf for a display rack permits the shelf to be pulled out to permit stocking and product rotation and permits it to be used in different sizes. A wire shelf is formed of hingedly connected sections with their sides connected to telescoping sheet metal side support brackets. The side support brackets are constructed and mounted so that they may be positioned to extend vertically either above or below plane of the wire shelving to selectively form side edges of the shelf. The rearmost section of the shelf when pivoted out of the plane of the shelf and held by a detent may contact product on the shelf to pull the product forward when the shelf is pulled out. This will allow restocking of fresh product at the rearmost section of the shelf when it is again pivoted down to the plane of the shelf.

7 Claims, 10 Drawing Figures

EXTENDABLE SHELF FOR A DISPLAY RACK

CROSS REFERENCE TO RELATED APPLICATIONS

This application is a continuation-in-part of prior application Ser. No. 383,614 filed June 1, 1982.

BACKGROUND OF THE INVENTION

1. Field of the Invention

This invention relates to improvements in display rack shelving and particularly to an extendable wire shelf which may be extended from one depth to another to permit restocking and to provide different depths for the shelf.

2. Prior Art

Display racks are commonly used in supermarkets and the like to display various items including dated snack products such as potato chips, corn chips and the like which must be constantly restocked for freshness. A typical display rack of the prior art is shown for example in U.S. Pat. No. 3,993,002 wherein wire shelves are connected to sheet metal side brackets which in turn are hooked to vertical upright members to provide support for the wire shelving.

The restocking of perishable snack products is important to the display and merchandising of such goods. Not only must the snack products be restocked for freshness, but snack availability and visibility stimulates usage as most snacks are purchased on impulse. The restocking of snack shelves on display racks is therefore quite important, but is also labor intensive and time consuming as the oldest snack items should be positioned in the front and the freshest snack packages in the rear for product rotation. At present this is done manually by a restocking salesman pulling the snack packages on the shelf forward by hand and restocking the new packages behind them. This is time consuming, especially for wide shelves with a large number of snack packages.

There is a need in the display rack shelf art for shelving of different depth for several purposes. For example, in some seasons snack products might sell or move from the shelves faster than in other seasons, e.g., in resort areas where most business is seasonal. Additionally, it is desirable to have different depth shelves for different space requirements of permanent displays, but this creates a problem of carrying a large inventory of different depth shelves.

Telescopic wire shelving as a general concept is known e.g., in the refrigerator art, see U.S. Pat. No. 2,103,885. Extendable depth or adjustable store display shelves are also broadly known, see for example U.S. Pat. Nos. 2,685,372 and 2,769,551. Telescoping trays for retractable display racks are broadly known, as in U.S. Pat. No. 3,403,789. However, there is a need in the art for a simple, inexpensive, adjustable depth wire shelf for display rack which can be adjusted to different depths of use and can be readily adapted to permit quick and efficient restocking and product rotation.

SUMMARY OF THE INVENTION

This invention provides an extendable wire shelf which can be pulled out in the manner of a drawer to permit stocking and product rotation, and alternatively can be used for at least two different depths of permanent shelving by telescoping the shelf supports and moving a rear portion of the wire shelf bottom. A rearmost section of the wire shelf bottom is lockable in an upright position so that when the shelf is pulled out the upright section will contact and pull product packages forward to more easily permit restocking and product rotation. This same position, (with the rearmost section of the shelf bottom upright) provides a narrower shelf, i.e., a shelf of lesser depth. The shelf construction includes side support brackets in multiple sections which are telescopically mounted and provide connections for support of the shelf from vertical display uprights. The side support brackets are pivotably connected to the side edges of the wire shelf bottom so they will extend either up or down from the plane of the shelf to selectively provide side gates. The principles of this invention can be used to convert a single depth wire shelf to an extendable wire shelf providing the features set forth above.

DETAILED DESCRIPTION OF THE PREFERRED EMBODIMENT

Figure 1:
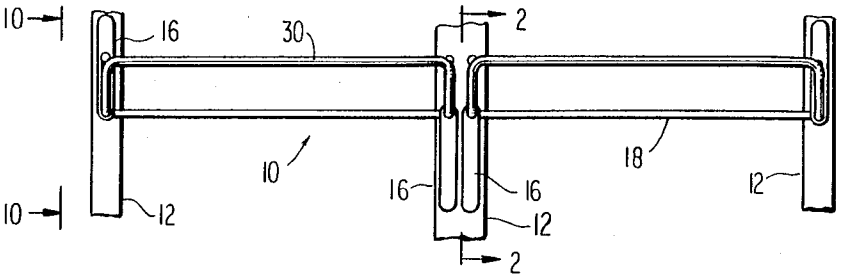
FIG. 1 is a front elevation view of the extendable shelf for a display rack of this invention.
Figure 3:
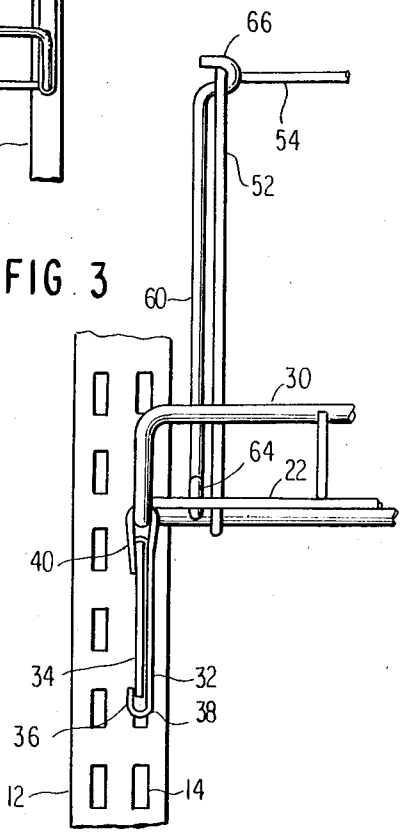
FIG. 3 is a partial front elevation view of a side edge of the extendable shelf shown in FIG. 2 in the retracted position.

An extendable shelf 10 is a portion of a display rack of the type which is hung on vertical support members 12. Support members 12 themselves can be free-standing or attached to vertical walls and are well known in the art. They conventionally have two vertical rows of slots 14 for attachment of shelf brackets to thus support shelves at desired horizontal levels and side-by-side if appropriate, see the center support 12 in FIG. 1.

The extendable shelf of this invention has side bracket means 16 at each side edge. Since the side edges on both ends of the shelf are identical, only one will be shown and described. The side bracket means attach to the vertical support members 12 via the slots 14.

The extendable shelf 10 has a generally planar wire bottom 18 formed by wires 20 extending the depth of the shelf, criss-crossed with wires 22 extending the length of the shelf. A border wire 24 extends around the edge of the shelf providing end portions 26, back portion 28, and an upstanding or raised front portion 30 to which the wires 20 and 22 are attached.

Each of the side bracket means 16 includes an outermost bracket section 32 and an innermost bracket section 34. The reference to outermost and innermost is with regard to the mounting support or vertical support members 12. Outermost bracket section 32 has in-turned edges 36 at the top and bottom thereof forming channels 38 which provide a track for movement of the innermost bracket section 34 which is planar sheet metal of a size to fit within the channels 38. The outermost bracket section 32 is attached to the edges of the wire bottom by means of attaching tangs 40 extending therefrom and looping over the side edge portion 26 of border wire 24.

Additionally, in both of the channels 38 there are a pair of outer cut-out sections 42 and inner cut-out sections 44 which are used for locating and positioning the bracket sections relative to each in either a shelf-extended or shelf-retracted position.

Figure 2:
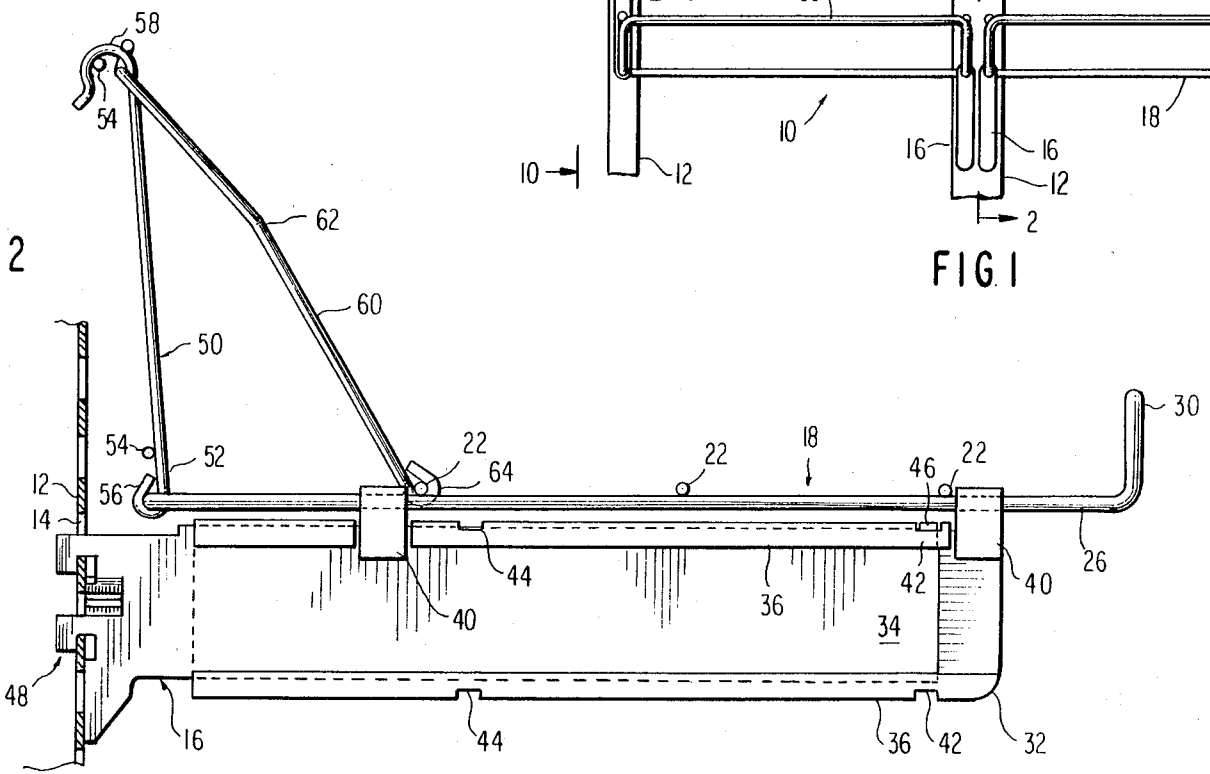
FIG. 2 is a section view taken along line 2—2 of FIG. 1 showing the extendable shelf of this invention in a retracted position.
Figure 4:
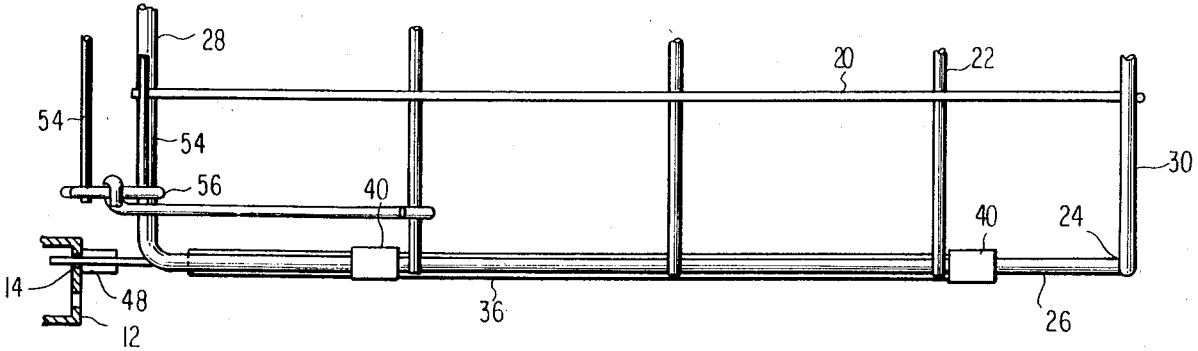
FIG. 4 a partial top plan view of the side edge of the shelf shown in FIG. 2 in the retracted position.
Figure 10:
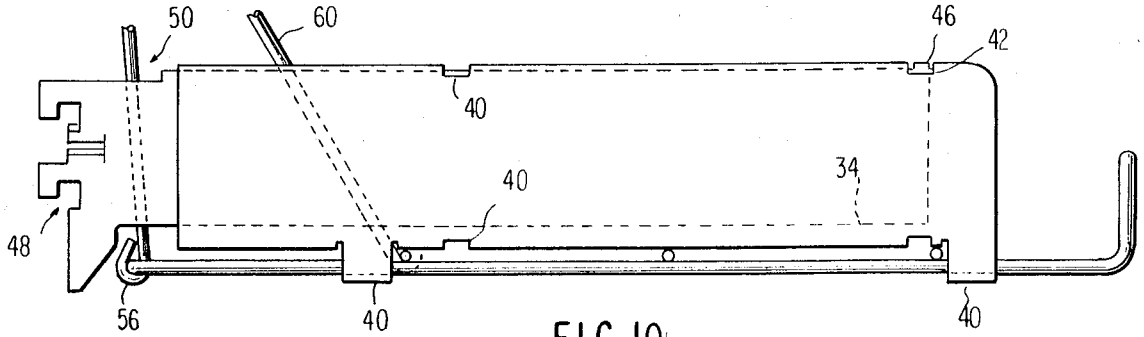
FIG. 10 is a elevation view taken along line 10—10 of FIG. 1 showing the shelf in its retracted position, but also showing the end bracket in an upstanding position to function as an end gate.

The innermost bracket section 34 has a planar body so as to be slidable and hence telescopically mounted within the outermost bracket section 32. The innermost bracket section 34 has an extending positioning tab 46 for cooperating with the outermost cut-out 42 or innermost cut-out 44 on either side of the outermost section 32 depending upon whether the outermost section 32 is positioned as shown in FIG. 2 or as shown in FIG. 10. The innermost bracket section 34 has a conventional bracket connector configuration 48 for attaching the innermost bracket section and hence the entire bracket means 16 to the slots 14 and vertical support members 12.

Figure 5:
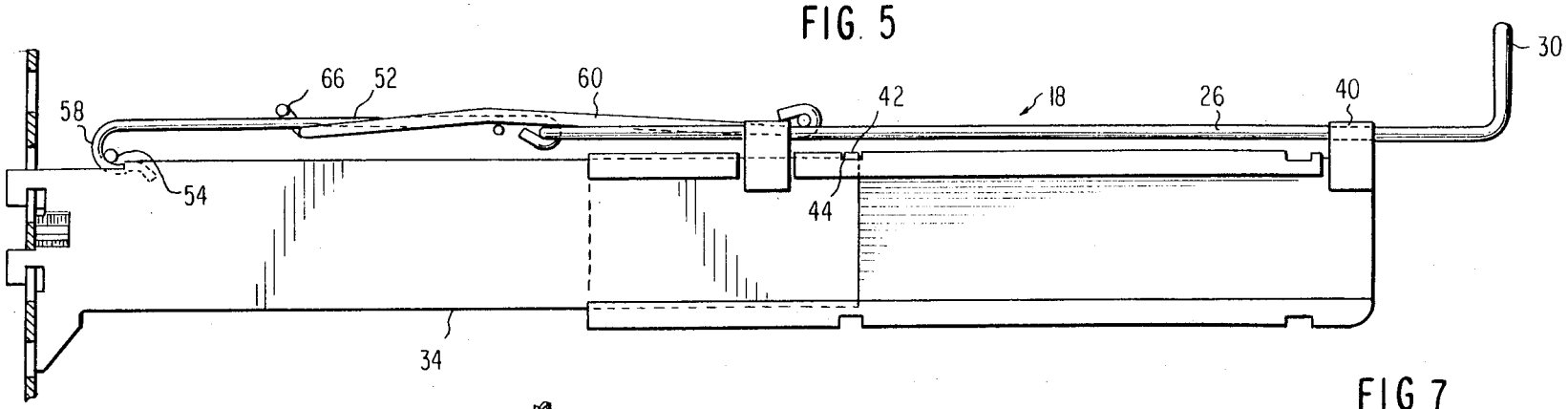
FIG. 5 is an end elevation view of the extendable shelf of this invention similar to the FIG. 2 view, but with the shelf shown in extended position.
Figure 6:
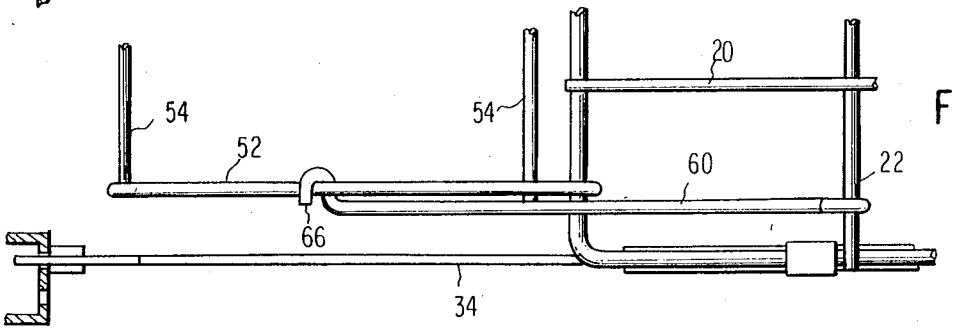
FIG. 6 is a partial top plan view similar to FIG. 4, but with the shelf shown in its extended position.

The wire bottom shelf 18 has an innermost shelf bottom section and combined package contacting means 50 which in the retracted position is raised and held by detent means in a substantially upright position as shown in FIGS. 2–4, and 10. Alternatively, the shelf can be extended with the bracket sections telescoped to their outermost position so that the innermost bottom section 50 will lie flat and form an extension of the shelf in its extended position as shown in FIGS. 5 and 6.

The innermost shelf bottom and packaging contacting means 50 is formed of wire edge pieces 52 connected by a longitudinal wire 54. One end of each piece 52 has a bent end pivot connection 56 for attaching to the back section 28 of border wire 24 and forming a pivotal connection. A top bend 58 is provided at the other end of edge piece 52 as a cooperating member for a detent.

Figure 7:
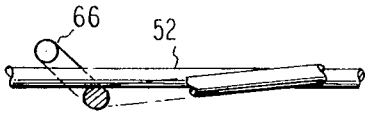
FIG. 7 is a fragmentary detail view of a detent connection shown with the shelf in extended position.
Figure 8:
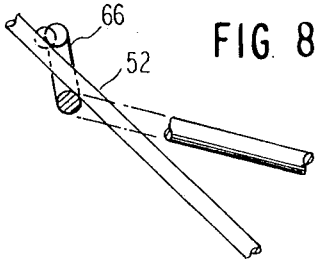
FIG. 8 is a fragmentary detail view of the detent connection with the shelf in an intermediate position between its extended and retracted position.
Figure 9:
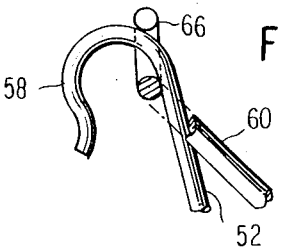
FIG. 9 is a fragmentary detail view of the detent construction with the shelf in its retracted position.

A detent link 60 has a bend 62 near its center and is provided with a bent-end pivotal connection 64 for pivotal connection to and movement around longitudinal wire 22 at one end, and an end crook 66 at the other end for cooperating with end piece 52 and operating as a detent as shown in more detail in FIGS. 7, 8, and 9.

In operation, the extendable shelf may be used as a portion of a display rack either alone or in combination with other shelves. The other shelves may be side-by-side as shown in FIG. 1, or above and below, or both. The extendable shelf may be used in the retracted position shown in FIGS. 2–4 or the extended position shown in FIGS. 5 and 6. When moving from the retracted to the extended position the innermost shelf bottom and package contacting means 50 will pull forward any material resting on the shelf in front of it. This allows restocking of fresh product at the rear when the shelf is moved from the FIG. 2 position to the FIG. 5 position because the package contacting means 50 has moved product on shelf bottom 18 outwardly and fresher product may be positioned on the innermost shelf bottom portion when it is forced from its erected position to its flat position. Additionally, the side brackets 16 may be used in an upstanding position to function as an end gate as shown on the ends of the shelf in FIG. 1 and in FIG. 10, or may be used in a position below the shelf bottom to allow two adjacent shelves to form a single continuous shelf as shown in the center of the shelf in FIG. 1 and in FIGS. 2 and 5.

To explain in more detail the operation of the above conversions reference may be made to FIG. 2 showing the extendable shelf in a retracted position, the package contacting member in an erected position held by detent link 60 in the FIG. 9 position, and with the bracket 16 in a lower and retracted position. This will provide a shelf of a predetermined depth equal to the depth of the wire bottom 18. When it is desired to extend the shelf to its extended position, it is merely pulled out from the wall, e.g., by pulling on front portion 30 and lifting it slightly so that tab 46 clears the cut-out 42. The outer bracket section 32 will move outwardly with the shelf bottom 18 and will telescope relative to the innermost bracket section 34. The movement is continued until positioning tab 46 rests in inner cut-out 44 as shown in FIG. 5. The inner shelf bottom portion and package contacting member 50 can then be moved down to a flat position as shown in FIG. 2 in which the components of the detent are in a position as shown in FIG. 7 and the crook 66 supports the edge pieces 52 in the flat position. In this extended position the shelf is of a depth equal to the depth of the innermost shelf bottom section 50 and the outermost section of the wire bottom 18. In this position the shelf bottom 18 was carried forward any packages, e.g., dated snack foods, in front of the package contacting member 50 thus when the package contacting member 50 is laid flat as shown in FIG. 5 by overcoming the detent new stock can be added to the shelf at the rear.

As shown in FIG. 7, the end crook 66 of detent link 60 supports the edge pieces 52 of the inner shelf bottom 50 in the horizontal position when the shelf is extended. In FIG. 9 the detent end crook 66 cooperates with top bend 58 to bind the top of end pieces 52 and form a detent. As shown in FIG. 8 in the intermediate position, there is slight binding and bending of the components when moving from the FIG. 7 to the FIG. 9 position.

In order to have the brackets 16 extend above the level of the wire bottom 18 as shown in FIGS. 1 (ends) and 10, the innermost bracket section 34, and outermost bracket section 32 are disassembled and the outermost bracket section 34 swung upwardly around an axis where attaching tang 40 surrounds edge portion 26 of border wire 24. In the upper position, FIG. 10, of the outermost bracket section 32, the innermost bracket 34 is reinserted and positioning tab 46 extends through the outer cut-out 42 in the shelf retracted position shown in FIG. 10. However, the shelf may be extended so that tab 46 extends into and is held by inner cut-out 42 even in the position with brackets extending above the plane of the shelf bottom to form end gates. In both positions of the bracket the weight of the shelf tends to force the outermost bracket section 32 downwardly and thus force the cut-out portions 42 and 44 downwardly to make a good connection with tab 46 and thereby hold the shelf in either the extended or retracted position.

The invention is also useful in converting conventional wire shelving to an extendable shelf in accordance with this invention. A conventional wire shelf has a wire bottom 18, cross-wires 20 and 22, and border wire 24 with non-extendable support brackets. In order to convert such a conventional shelf to an extendable shelf of the present invention the conventional side brackets are replaced by the telescoping side brackets of the present invention and attached to edge portions 26 by bending attaching tangs 40. Additionally, the innermost shelf bottom and package contacting member 50 is secured by bending bent-end pivot connections 56, and detent links 60 are secured by bending bent-end pivotal connectors 64. With these additional components and simple mechanical operations a conventional shelf can be converted to a shelf of different depths which, when the innermost section is in erected position, can also be used as a package contacting member.

What is claimed is:

1. An extendable shelf for a display rack, the shelf being extendable to provide a deeper shelf area, the shelf being of the type used on display racks having vertical support members, a pair of spaced apart side support members, a pair of spaced apart side support brackets, and a spaced wire shelf bottom extending between the side support brackets, the brackets being connected to the vertical supports for attaching the shelf to a form part of a display rack, with improvements for making the shelf extendable to provide a deeper shelf area and for allowing restocking of packages behind packages on the shelf at the time of restocking, the improvements comprising; each of the side support brackets being in at least two sections, an outermost section and an innermost section, means telescopically mounting the side support brackets sections with regard to each other, the shelf bottom being formed of at least two movably related sections with the outermost section attached to the outermost section of the side support brackets and movable therewith to decrease the depth of the shelf when the side support brackets are telescoped inwardly with respect to each other, and package-contacting means extending above the plane of the shelf bottom and across the length of outermost shelf bottom section at the base portion thereof and movable therewith for contacting packages and moving the packages forwardly as the shelf is pulled out thereby moving packages on the outermost shelf bottom section forward and to thereby allow restocking of fresh packages to the rear of the shelf behind the package-contacting member.

2. An extendable shelf for a display rack as defined in claim 1, wherein an innermost section of the shelf bottom is pivotally connected to the outermost section of the shelf bottom for movement upwardly out of the plane of the shelf bottom, and wherein the innermost section constitutes the package contacting means.

3. An extendable shelf for a display rack as defined in claim 2, further comprising a detent means for releasably locking the innermost section of the shelf bottom in a generally upright position.

4. An assembly for converting a conventional wire bottom shelf of the type which is attachable to uprights at vertically adjustable positions by means of brackets on the side edges of the shelf, to a convertible depth shelf with provisions to allow use at two separate depths and to allow for restocking, the assembly comprising:

an innermost shelf bottom member of the same length as the conventional wire bottom shelf and of lesser depth;

means for pivotally attaching the innermost shelf bottom member to the back edge of the conventional wire bottom shelf;

detent means for holding the innermost shelf bottom member and the conventional wire bottom to hold the shelf bottom back in a generally upright position; and telescoping two-section bracket means for each side of the wire bottom and innermost shelf bottom member one section of the bracket means attached to a side edge of the conventional wire bottom shelf and another section of the bracket means attached to a supporting bracket.

5. An assembly for converting a conventional wire bottom shelf of the type which is attachable to uprights at vertically adjustable positions by means of brackets on the side edges of the shelf, to a convertible depth shelf with provisions to allow use at two separate depths and to allow for restocking, the assembly comprising:

an innermost shelf bottom member of the same length as the conventional wire bottom shelf and of lesser depth;

means for pivotally attaching the innermost shelf bottom member to the back edge of the conventional wire bottom shelf;

detent means for holding the innermost shelf bottom member and the conventional wire bottom to hold the shelf bottom back in a generally upright position; and telescoping two-section bracket means for each side of the wire bottom and innermost shelf bottom member, one section of the bracket means attached to a side edge of the conventional wire bottom shelf and another section of the bracket means attached to a supporting bracket, and wherein the bracket means are pivotally attached to the side edge of the shelf bottom to allow the bracket to selectively extend either above or below the plane of the wire shelf bottom.

6. An extendable shelf for a display rack comprising:

a wire bottom shelf formed in two section, an outermost section and an innermost section;

means hingedly connecting the outermost and innermost sections of the shelf bottom;

means for selectively holding the rearmost section of the shelf bottom in a generally upright position;

shelf side support brackets pivotally attached to each side of the outermost shelf bottom and having means for attachment to vertical upright members, each shelf bracket being formed in sections to be telescoping to the extent of movement allowed between flat and upright positions of the rearmost shelf section, and wherein the side shelf bracket sections are selectively connected to the shelf bottom with the brackets extending vertically above or below a horizontal plane of the shelf bottom to selectively provide end gates for the shelf at the point of the bracket position.

7. An extendable shelf as defined in claim 5, further comprising stop means incorporated in the bracket means to allow positioning of the bracket means at either one of two positions, depending on whether the shelf is pulled out to its full depth or pushed in to its shortened depth with the rearmost section generally upright.

* * * * *